US011434597B2

(12) United States Patent
Lv et al.

(10) Patent No.: US 11,434,597 B2
(45) Date of Patent: Sep. 6, 2022

(54) AUTOMATIC DELIVERY SYSTEM FOR A WASHING MACHINE AND WASHING MACHINE

(71) Applicants: CHONGQING HAIER DRUM WASHING MACHINE CO., LTD., Chongqing (CN); HAIER SMART HOME CO., LTD., Shandong (CN)

(72) Inventors: Peishi Lv, Shandong (CN); Liping Li, Shandong (CN); Tao Huang, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 245 days.

(21) Appl. No.: 16/606,095

(22) PCT Filed: Apr. 17, 2018

(86) PCT No.: PCT/CN2018/083266
§ 371 (c)(1),
(2) Date: Oct. 17, 2019

(87) PCT Pub. No.: WO2018/192460
PCT Pub. Date: Oct. 25, 2018

(65) Prior Publication Data

US 2020/0048815 A1 Feb. 13, 2020

(30) Foreign Application Priority Data

Apr. 17, 2017 (CN) ..... 201710248442.1
Apr. 17, 2017 (CN) ..... 201710248516.1
(Continued)

(51) Int. Cl.
*D06F 39/02* (2006.01)
*D06F 39/08* (2006.01)

(52) U.S. Cl.
CPC ..... *D06F 39/02* (2013.01); *D06F 39/088* (2013.01)

(58) Field of Classification Search
None
See application file for complete search history.

(56) References Cited

U.S. PATENT DOCUMENTS 7,398,787 B2 7/2008 Hsu et al.
2007/0131000 A1 6/2007 Jeong
(Continued)

FOREIGN PATENT DOCUMENTS

CN 2292106 Y 9/1998
CN 2378418 Y 5/2000
(Continued)

OTHER PUBLICATIONS

Espacenet translation CN 106436188A, Wuxi Little Swan Co, Detergent bottle used for washing machine (Year: 2017).*
(Continued)

*Primary Examiner* — Cristi J Tate-Sims
(74) *Attorney, Agent, or Firm* — Buchanan Ingersoll & Rooney PC

(57) ABSTRACT

An automatic delivery system for a washing machine, and a washing machine, are provided. The automatic delivery system comprises: a water box provided with a main water inlet pipeline and a detergent delivery pipeline; a distribution box arranged inside the water box and provided with at least one installation cavity for accommodating a washing additive box; the washing additive box being installed in the installation cavity, and being provided with an unidirectional ventilation structure and a liquid outlet, and a negative
(Continued)

pressure extraction mechanism, the negative pressure extraction mechanism comprising a Venturi tube arranged in the main water inlet pipeline, the washing additive being drawn out of the washing additive box and delivered into the washing barrel by a negative pressure generated by water flow through an outlet of the Venturi tube.

18 Claims, 8 Drawing Sheets

(30) Foreign Application Priority Data

Apr. 17, 2017 (CN) ..... 201710248518.0
Apr. 17, 2017 (CN) ..... 201710248550.9

(56) References Cited

U.S. PATENT DOCUMENTS

| | | | | |
|---|---|---|---|---|
| 2010/0161143 | A1 | 6/2010 | Smith et al. | |
| 2012/0240344 | A1* | 9/2012 | Lv | A47L 15/4463 8/137 |

FOREIGN PATENT DOCUMENTS

| | | | |
|---|---|---|---|
| CN | 1461844 | A | 12/2003 |
| CN | 1749473 | A | 3/2006 |
| CN | 1779047 | A | 5/2006 |
| CN | 1978743 | A | 6/2007 |
| CN | 101381939 | A | 3/2009 |
| CN | 101956311 | A | 1/2011 |
| CN | 102086586 | A | 6/2011 |
| CN | 102345223 | A | 2/2012 |
| CN | 102409516 | A | 4/2012 |
| CN | 202273112 | U | 6/2012 |
| CN | 102899855 | A | 1/2013 |
| CN | 203334042 | U | 12/2013 |
| CN | 104746308 | A | 7/2015 |
| CN | 105350261 | A | 2/2016 |
| CN | 105624987 | A | 6/2016 |
| CN | 105937145 | A | 9/2016 |
| CN | 106222955 | A | 12/2016 |
| CN | 106222957 | A | 12/2016 |
| CN | 106319876 | A | 1/2017 |
| CN | 106400405 | A | 2/2017 |
| CN | 106400408 | A | 2/2017 |
| CN | 106436188 | A | 2/2017 |
| CN | 107130403 | A | 9/2017 |
| CN | 107815819 | A | 3/2018 |
| DE | 2251145 | A1 | 7/1973 |
| DE | 3701118 | A1 | 7/1988 |
| EP | 0611843 | A1 | 8/1994 |
| EP | 1607509 | A1 | 12/2005 |
| EP | 3075897 | A1 | 10/2016 |
| JP | 2012223407 | A | 11/2012 |
| KR | 20100034927 | A | 4/2010 |
| WO | 2013114106 | A1 | 8/2013 |

OTHER PUBLICATIONS

International Search Report (PCT/ISA/210) dated Jul. 23, 2018, by the State Intellectual Property Office of the P.R. China as the International Searching Authority for International Application No. PCT/CN2018/083266.

Written Opinion (PCT/ISA/237) dated Jul. 23, 2018, by the State Intellectual Property Office of the P.R. China as the International Searching Authority for International Application No. PCT/CN2018/083266.

* cited by examiner

AUTOMATIC DELIVERY SYSTEM FOR A WASHING MACHINE AND WASHING MACHINE

TECHNICAL FIELD

The present disclosure belongs to the field of a washing machine, in particular relates to an automatic delivery system for a washing machine and a washing machine.

BACKGROUND ART

For a traditional washing machine, a washer needs to judge the amount of detergent manually added according to experience before the start of washing, thereby not only increasing workload for the washer, but also easily leading to unclean washed clothes or waste of detergent due to improper control of the amount of detergent. Therefore, in the prior art, an automatic delivery technique of detergent is proposed, washing additive and softener which can be used for multiple washings are poured into a detergent distribution box at a single time, and are automatically added according to requirements during each time of clothes washing.

At present, many types of washing machines with a function of automatically delivering detergent and other liquid additives are available, however, a user has to add by himself after buying canned or bottled detergent in most cases, and a delivery device is often inconvenient to operate. The user finds it troublesome during use, and detergent is easily leaked during an adding process. When residue detergent remains in a delivery device, it is unachievable for a user to change other types of detergent.

In view of this, the present disclosure is hereby proposed.

SUMMARY OF THE DISCLOSURE

A technical problem to be solved in the present disclosure is to overcome shortcomings of the prior art, and provide an automatic delivery system for a washing machine and a washing machine, so as to automatically deliver multiple types of washing additives simultaneously. The user can change washing additive boxes at will according to his own preference and requirements, and adopts different types of washing additive aiming at different clothes washed at each time to improve clothes washing experience and efficiency.

In order to solve the above technical problem, a basic conception of the technical solution adopted in the present disclosure is as follows:

A first object of the present disclosure is to provide an automatic delivery system for a washing machine.

An automatic delivery system for a washing machine includes, a water box provided with a water outlet configured to be communicated with a washing barrel of a washing machine, a main water inlet pipeline and a detergent delivery pipeline, a distribution box arranged inside the water box, the distribution box being internally provided with at least one installation cavity for accommodating a washing additive box;

the washing additive box being installed in the installation cavity, the washing additive box being a closed box body with a cavity for accommodating washing additive, and being provided with an unidirectional ventilation structure and a liquid outlet, the liquid outlet being open when the washing additive box is communicated with the detergent delivery pipeline, and the liquid outlet being close when the washing additive box is disconnected with the detergent delivery pipeline; and a negative pressure extraction mechanism including a Venturi tube arranged in the main water inlet pipeline, the washing additive being drawn out of the washing additive box and delivered into the washing barrel by a negative pressure generated by water flow through an outlet of the Venturi tube. In a further solution, the distribution box is provided with a first installation part having at least one installation cavity and a second installation part for enabling a washing powder delivery box to be arranged therein, the washing additive box is installed in the first installation part, the washing powder delivery box is provided with a washing powder delivery cavity, and the washing powder delivery cavity is respectively communicated with an outlet of the main water inlet pipeline and a water outlet of the water box to pour washing powder into the washing barrel.

In a further solution, the distribution box is provided with a first installation part having at least one installation cavity and a second installation part for enabling a disposable delivery box to be arranged therein, the washing additive box is installed in the first installation part, the disposable delivery box is provided with a disposable delivery cavity, the disposable delivery cavity is internally provided with a siphon structure, the disposable delivery cavity is communicated with an outlet of the main water inlet pipeline located at an upstream of the disposable delivery cavity, and an outlet of the siphon structure is communicated with a water outlet of the water box.

In a further solution, the distribution box is provided with a first installation part having at least one installation cavity, a second installation part for enabling a disposable delivery box to be arranged therein and a third installation part for enabling a washing powder delivery box to be arranged therein, and the washing additive box is installed in the first installation part, the disposable delivery box is provided with a disposable delivery cavity having a siphon structure internally; the disposable delivery cavity is communicated with an outlet of the main water inlet pipeline located at an upstream of the disposable delivery cavity, and an outlet of the siphon structure is communicated with a water outlet of the water box; and the washing powder delivery box is provided with a washing powder delivery cavity, the washing powder delivery cavity is respectively communicated with an outlet of the main water inlet pipeline and a water outlet of the water box to pour washing powder into the washing barrel.

In a further solution, at least two washing additive boxes are arranged, a switching mechanism is further included, the switching mechanism is provided with inlets corresponding to the number of washing additive boxes and at least one outlet, each inlet of the switching mechanism is correspondingly communicated with one washing additive box, and at least one outlet is communicated with a main water inlet pipeline.

In a further solution, an air pressure difference between an inner and an outer of the washing additive box makes the unidirectional ventilation structure be open for unidirectional air permeability, or makes the unidirectional ventilation structure be close to seal the washing additive box.

Preferably, the unidirectional ventilation structure includes an ventilation element and a switching element, the ventilation element is provided with a venting hole, the switching element includes a switching part, and an air pressure difference between the inner and the outer of the washing additive box makes the switching part be open or close to make the venting hole ventilate unidirectionally or close.

In a further solution, the washing additive box is provided with a liquid inlet, a liquid inlet cover is arranged at the liquid inlet in a detachable and sealed manner, and the unidirectional ventilation structure is arranged on the liquid inlet cover in a sealed manner.

In a further solution, the washing additive box is further provided with a liquid outlet device, the liquid outlet device is arranged at the liquid outlet of the washing additive and includes an on-off valve arranged on the liquid outlet and a suction device arranged in the washing additive box, and an inlet of the suction device is communicated with the washing additive box, and an outlet is communicated with an inlet of the on-off valve.

In a further solution, the suction device is a hollow tubular structure, a flow channel is formed inside the suction device, one end of the flow channel faces a bottom wall of the washing additive box, and another end of the flow channel is communicated with the inlet of the on-off valve.

Preferably, a diversion channel with a cambered shape is formed between an inlet and an outlet in the flow channel, and a diversion point of the flow channel corresponding to the inlet of an on-off valve is an arc surface extended outwardly; preferably, a radius of the arc surface is larger than a radius of the flow channel.

In a further solution, the on-off valve includes a drainage channel and a piston and a reset spring arranged in the drainage channel, and the piston blocks the drainage channel under the effect of the reset spring.

Preferably, a sealing element for sealing a connecting point between the liquid outlet and the switching mechanism is arranged in the liquid outlet or the drainage channel of the on-off valve.

In a further solution, the installation cavity is provided with a limit structure, the limit structure includes an elastic piece arranged at one side of the installation cavity, and the elastic piece is configured to be arranged between the washing additive box and a side wall of the installation cavity in an elastically deformed manner when the washing additive box is placed in the installation cavity.

In a further solution, multiple washing additive boxes are arranged in the installation cavity in a mutually parallel manner, the limit structure further includes at least one separating rib arranged at a bottom wall of an installation cavity for separating one washing additive box from each other.

Preferably, the separating rib and the elastic piece are set in a homonymous manner, the separating rib limits movement of a washing additive box in a first direction, and the elastic piece limits movement of the washing additive box in a second direction vertical to the first direction.

In a further solution, a hand buckling position is arranged on a side wall of the installation cavity opposite to the elastic piece; and a protruding structure for increasing a friction force is arranged, corresponding to a hand buckling position, on the washing additive box;

Preferably, the hand buckling position is a concave part formed by the outward extension of a side wall of the installation cavity.

In a further solution, the installation cavity and the washing powder delivery box are set to be adjacent to each other in a parallel manner, the washing powder delivery cavity is internally provided with a diversion plate, the diversion plate extends from one side wall of the washing powder delivery cavity to an opposite side wall in an inclined manner, a bottom wall of the washing powder delivery cavity is provided with a washing powder outlet, and the washing powder outlet is communicated with the water outlet of a water box.

Preferably, the washing powder outlet is arranged at a tail end of the diversion plate, the tail end of the diversion plate is arranged in a suspending manner, and is lower than the height of an initial end of the diversion plate.

In a further solution, the installation cavity and multiple disposable delivery boxes are adjacent to each other in a parallel manner, an open end of the disposable delivery cavity is further provided with a delivery funnel, and an outlet of the delivery funnel is relative to the opening of the disposable delivery cavity.

Preferably, a bottom part of the delivery funnel is provided with a siphon cap in an integrated manner, a siphon column is integrally disposed at a position corresponding to the siphon cap, in the disposable delivery cavity, and an outlet of the siphon column is communicated with a water outlet of a water box.

In a further solution, the distribution box includes an upper box and a lower box, the upper box and the lower box are detachable or integrated, the lower box is provided/connected with a diversion structure communicated to the water outlet of the water box, the installation cavity, the disposable delivery box and the washing powder delivery box are arranged in the upper box, a bottom wall of the installation cavity is formed with a through hole which is communicated with the lower box, an outlet of the siphon structure is communicated with the lower box, and the outlet of the washing powder delivery box is communicated with the lower box.

Preferably, the through hole is close to the liquid outlet of the washing additive box.

A second object of the present disclosure is to provide a washing machine which is provided with the above automatic delivery system.

After the above technical solution is adopted, the present disclosure has the following beneficial effects:

An automatic delivery system for a washing machine in the present disclosure can solve a burden of manually adding detergent and avoid the problem of adding too little or too much detergent. Compared with other structures which can automatically add detergent, the automatic delivery system for a washing machine in the present disclosure saves cost in production and installation, saves internal space of a washing machine, and realizes diversification of a detergent adding process.

An automatic delivery system for a washing machine provided in the present disclosure includes multiple sealed washing additive boxes which can accommodate multiple types of washing additives. A user can change washing additive boxes at will according to his own preference and requirements. When detergent in a washing additive box is not used up, if a user needs to change another type of detergent to wash different clothes, he can conveniently take out the washing additive box, and change into other washing additive boxes, and detergent is not easy to leak, thereby realizing automatic delivery of multiple types of washing additives, and improving clothes washing experience and efficiency.

Meanwhile, the present disclosure adopts a clothes washing method in which detergent is automatically added, in the method, detergent of a most reasonable amount is automatically added by utilizing a negative pressure generated by water flow under a premise of not influencing washing effect, the structure is simple, thereby not only preventing too little or too much detergent which is added manually, saving cost caused by other structures for automatically adding detergent, but also reducing environmental pollution caused by discharged washing water. Meanwhile, automation of a clothes washing process is realized, and clothes washing efficiency is improved.

A further detailed description will be given below on specific embodiments of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for those skilled in the art, other drawings can be obtained based on these drawings without any creative effort. In the drawings.

Figure 1:
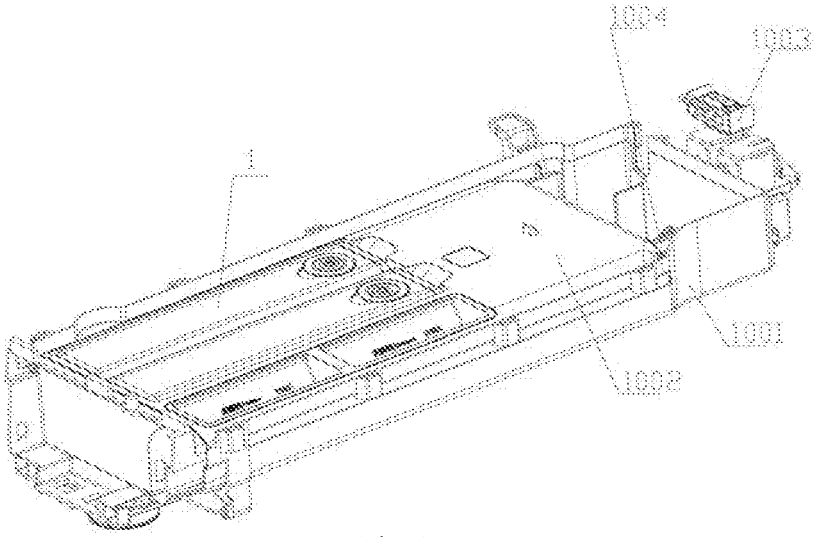
FIG. 1 is a schematic diagram of a three-dimensional structure of an automatic delivery system for a washing machine in the present disclosure.
Figure 2:
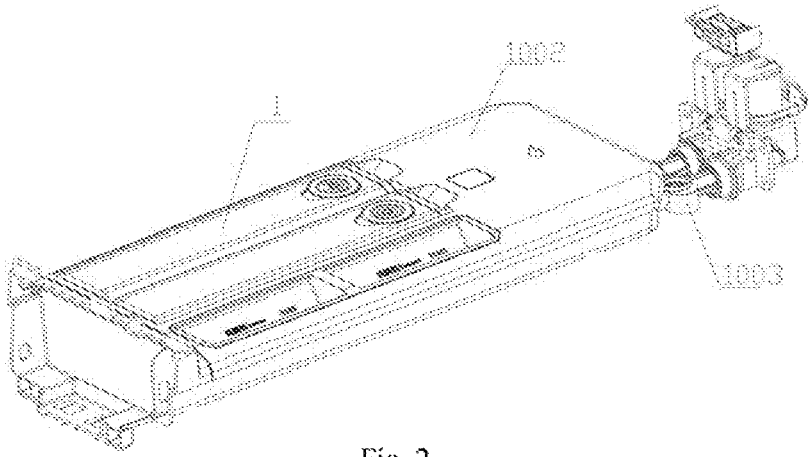
FIG. 2 is a three-dimensional diagram of installation of a side face of a distribution box, a washing additive box and a switching mechanism of an automatic delivery system for the washing machine.
Figure 3:
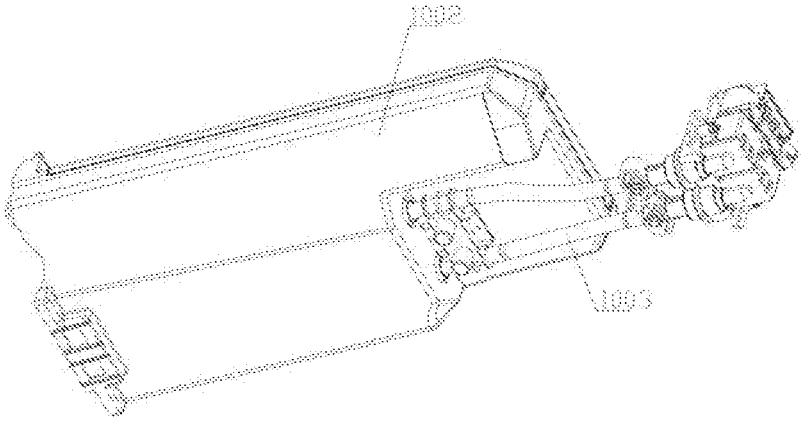
FIG. 3 is a three-dimensional diagram of installation of a back side of a distribution box, a washing additive box and a switching mechanism of an automatic delivery system for the washing machine.
Figure 4:
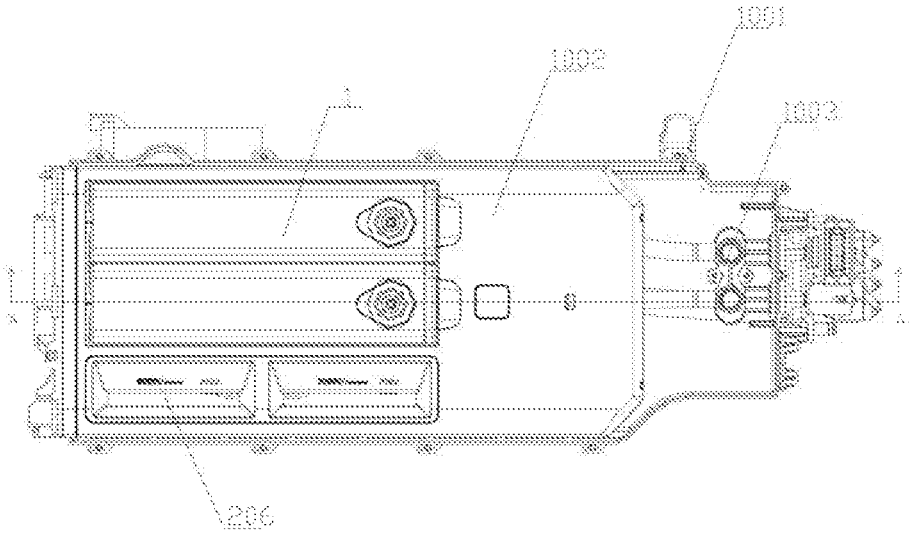
FIG. 4 is a schematic diagram of a top view of a distribution box, a washing additive box and a switching mechanism of an automatic delivery system for the washing machine.
Figure 5:
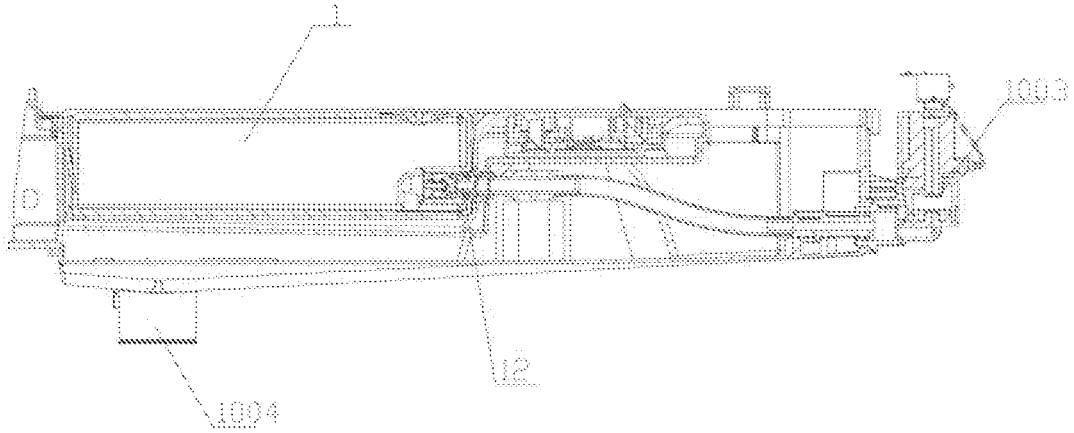
FIG. 5 is a section view of FIG. 4 along an A-A direction.
Figure 6:
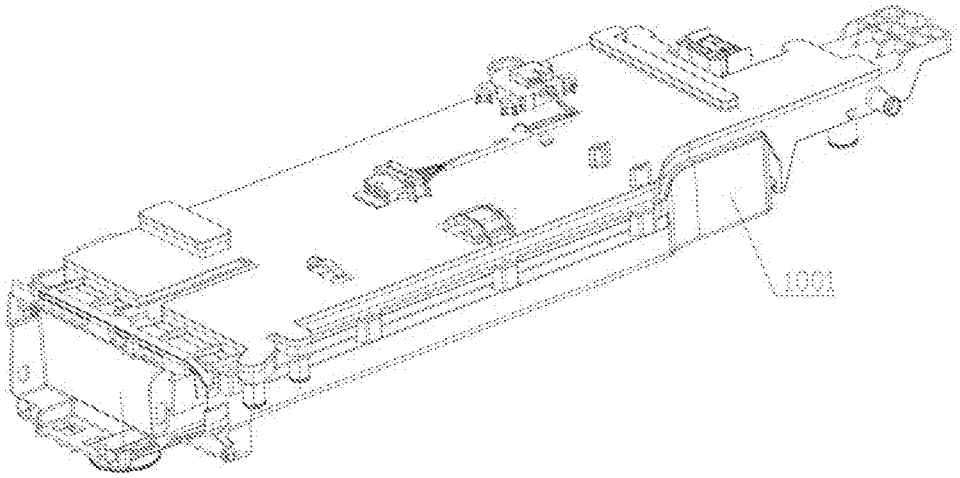
FIG. 6 is an overall three-dimensional diagram of an automatic delivery system for the washing machine.
Figure 7:
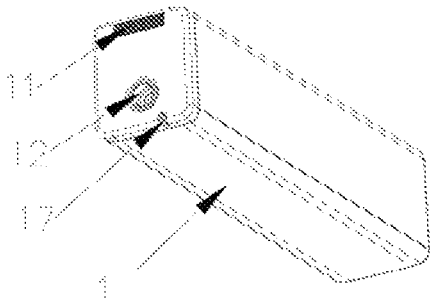
FIG. 7 is a three-dimensional diagram of a washing additive box.
Figure 8:
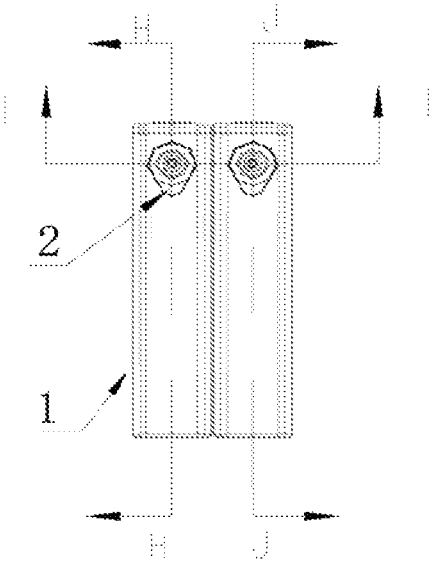
FIG. 8 is a top view of a washing additive box.
Figure 9:
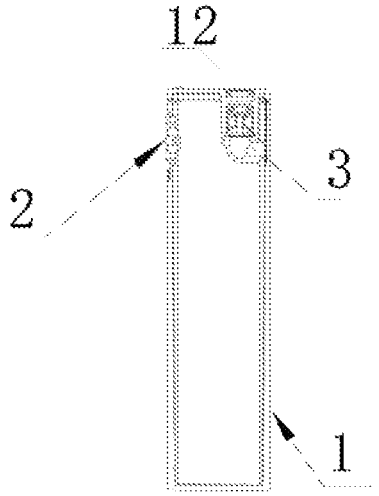
FIG. 9 is a section view of H-H of a washing additive box in FIG. 8.
Figure 10:
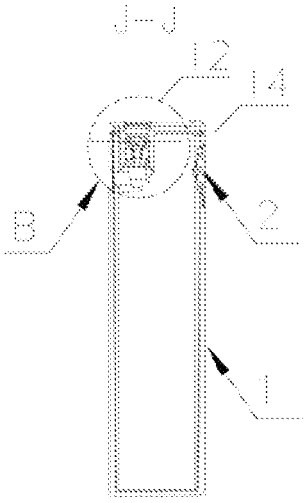
FIG. 10 is a section view of J-J of a washing additive box in FIG. 8.
Figure 11:
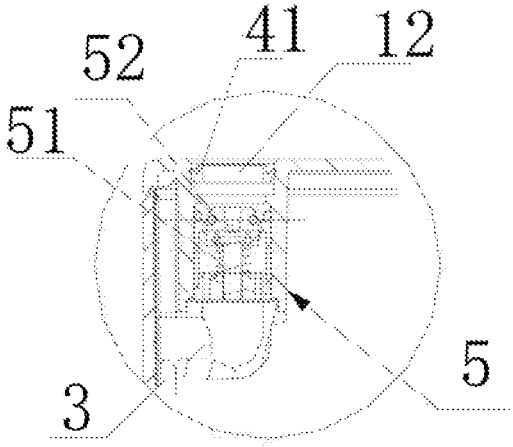
FIG. 11 is an enlarged view of part B of a washing additive box in FIG. 10.
Figure 12:
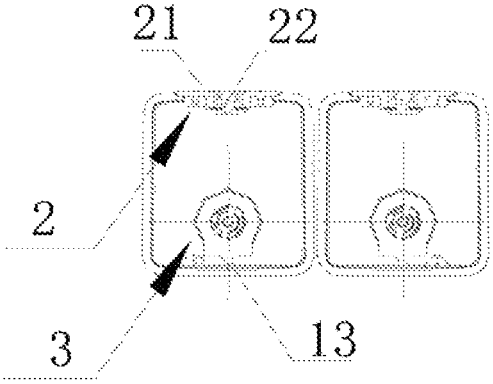
FIG. 12 is a section view of I-I of a washing additive box in FIG. 8.
Figure 13:
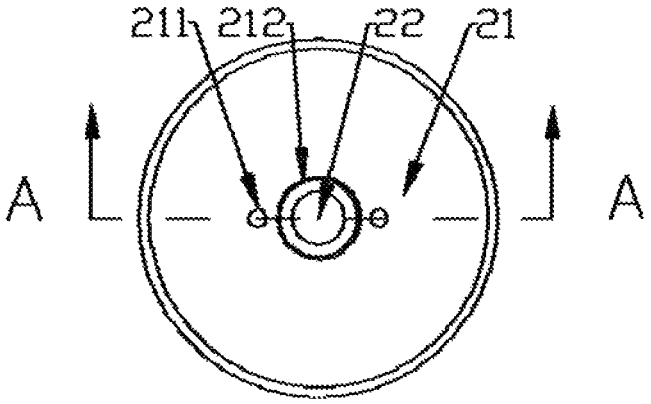
FIG. 13 is a schematic diagram of a top view of a unidirectional ventilation structure.
Figure 14:
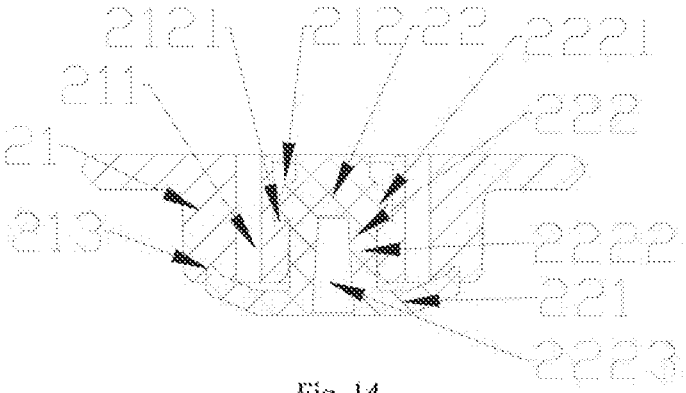
FIG. 14 is a section view of a unidirectional ventilation structure of FIG. 13 along an A-A direction.

Reference numerals in the figures: 1001, water box; 1002, distribution box; 1003, switching mechanism; 1004, water outlet; 1, washing additive box; 11, protruding structure; 12, liquid outlet; 13, groove; 2, unidirectional ventilation structure; 21, ventilation element; 211, venting hole; 212, connecting hole; 2121, clamping boss; 213, annular groove; 22, switching element; 221, switching part; 222, connecting part; 2221, annular boss; 2222, transition segment; 2223, hollow hole; 3, suction device; 41, seal ring; 5, on-off valve; 51, reset spring; 52, piston; 6, delivery funnel; 61, siphon cap; 62, siphon column; 10, upper box; 101, through hole; 102, evading opening; 103, separating rib; 20, lower box; 201, evading opening; 202, installation cavity; 14, liquid inlet; 141, guide part; 15, installation concave part; 2', liquid inlet cover, 21', first cover body; 211', venting hole; 212', connecting hole; 2121', clamping boss; 213', annular groove; 214', concave part; 215', connecting part; 22', switching element; 221', switching part; 222', connecting transition segment; 2221', annular boss; 2223', hollow hole; 23', second cover body; 231', groove; 232', transition part; 203, hand buckling position; 204, elastic piece; 205, stopping part; 206, disposable delivery cavity.

It should be noted that, these drawings and text descriptions are not aiming at limiting a conception range of the present disclosure in any form, but to describe concepts of the present disclosure for those skilled in the art with a reference to specific embodiments.

DETAILED DESCRIPTION OF THE EMBODIMENTS

In order to make the object, technical solutions and advantages of the present disclosure clearer, a clear and complete description will be given below on technical solutions in the embodiment in combination with accompanying drawings in embodiments of the present disclosure. The following embodiments are used for describing the present disclosure, rather than for limiting the scope of the present disclosure.

Embodiment 1

As shown in FIGS. 1-22, the present embodiment provides an automatic delivery system for a washing machine which includes a water box 1001, the water box 1001 is provided with a water outlet 1004 which is communicated with a washing barrel of the washing machine, and is integrated with a main water inlet pipeline and a detergent delivery pipeline, and the automatic delivery system further includes:

a distribution box 1002 arranged inside a water box 1001, wherein the distribution box 1002 is internally provided with at least one installation cavity for placing a washing additive box 1;

a washing additive box 1, the washing additive box 1 is a closed box body structure which is internally provided with a cavity for accommodating washing additive, the washing additive box 1 is provided with a unidirectional ventilation structure 2 and a liquid outlet 12, the washing additive box 1 is installed in the installation cavity, the liquid outlet 12 is open when the washing additive box 1 is communicated with the detergent delivery pipeline, and the liquid outlet 12 is closed when the washing additive box 1 is disconnected with the detergent delivery pipeline; and a negative pressure extraction mechanism which includes a Venturi tube arranged in a main water inlet pipeline, the washing additive being drawn out of the washing additive box 1 and delivered into the washing barrel by a negative pressure generated by water flow through an outlet of the Venturi tube.

As shown in FIGS. 1-6, an automatic delivery system for the washing machine in the present embodiment includes a water box 1001 assembled in the washing machine and a distribution box 1002 arranged in the water box 1001. The water box 1001 is a box body structure with an opening being formed at a front part, and the distribution box 1002 is arranged in the water box 1001 in an openable and closable manner through the opening. Or, the water box 1001 can also be a box body structure with an opening being formed at a top part, the distribution box 1002 is installed in the water box 1001, and the distribution box 1002 is provided with a push-pull cover or a rotating cover. The water box 1001 is provided with a main water inlet and a water outlet which is communicated with the washing barrel of the washing machine. The water box 1001 is integrated with the main water inlet pipeline, and the main water inlet is communicated with the main water inlet pipeline. The detergent delivery pipeline is respectively communicated with the main water inlet pipeline and the washing additive box 1.

The distribution box 1002 is provided with at least one installation cavity for placing the washing additive box 1, one or more washing additive boxes 1 are installed in the installation cavity. The washing additive box 1 is a closed box body structure which is internally provided with a cavity for accommodating washing additive, the washing additive box 1 is provided with an unidirectional ventilation structure and a liquid outlet. The washing additive box is installed in the installation cavity, the liquid outlet is open when the washing additive box is communicated with the detergent delivery pipeline, and the liquid outlet is closed when the washing additive box is disconnected with the detergent delivery pipeline. In this way, leakage of washing additive can be avoided, and the distribution box 1002 can be kept clean.

For a drawer-type distribution box, the washing additive box is installed in an installation cavity, when the distribution box is pushed into the water box, the distribution box is communicated with the detergent delivery pipeline, and the liquid outlet is open; when the distribution box is pulled out of the water box, the distribution box is disconnected from the detergent delivery pipeline, and the liquid outlet is closed. For a top-openable distribution box, when the washing additive box is installed in the installation cavity, that is, when the washing additive box is communicated with the detergent delivery pipeline, the liquid outlet is open and departs from the installation cavity, the liquid outlet is closed.

A negative pressure extraction mechanism includes a Venturi tube arranged in the main water inlet pipeline and a negative pressure pipeline arranged at a rear side of an outlet of a Venturi tube, and the negative pressure pipeline is communicated with the washing additive box 1. The negative pressure pipeline is provided with a flow valve configured to detect flow of washing additive, and the negative pressure extraction mechanism is integrated on the water box 1001.

The detergent delivery pipeline includes the negative pressure pipeline of the negative pressure extraction mechanism. The liquid in the washing additive box was drawn out by a negative pressure generated by flow of water flow through the outlet of the Venturi tube via a detergent delivery pipeline, and liquid is delivered to a washing barrel through a main water inlet pipeline, or a separate constant volume box and a flushing pipeline, or other pipelines. The following solution below is a solution in which liquid enters into a washing barrel via a main water inlet pipeline;

In a process in which water enters via a main water inlet pipeline, a relative low barometric pressure area is formed at a rear side of an outlet of a Venturi tube, since a negative pressure pipeline is communicated with a washing additive box 1, liquid in the washing additive box 1 is guided into the main water inlet pipeline under the effect of negative pressure. And the outlet of the main water inlet pipeline is communicated with the water outlet of the water box 1001. Therefore, water flow carries a certain amount of washing additive to enter into a washing barrel via a water outlet of a water box 1001, thereby assisting in washing clothes.

In a further solution, at least two washing additive boxes 1 are arranged, an automatic delivery system for the washing machine further includes a switching mechanism 1003. The switching mechanism 1003 is provided with inlets with the number being corresponding to the number of washing additive boxes 1 and at least one outlet. Each inlet is respectively communicated with a corresponding washing additive box 1, and at least one outlet is communicated with the negative pressure extraction mechanism. In order to facilitate automatic delivery of multiple different washing additives, the switching mechanism 1003 is arranged on the washing additive delivery pipeline, and is arranged between the washing additive box 1 and a negative pressure extraction mechanism. The switching mechanism 1003 is provided with inlets with the number being corresponding to the number of washing additive boxes 1 and at least one outlet, each inlet is respectively communicated with a corresponding washing additive box 1, and at least one outlet is communicated with the negative pressure extraction mechanism. Each inlet and outlet of the switching mechanism 1003 is provided with a control valve configured to control connection and disconnection of each inlet and outlet. Through controlling connection and disconnection of each inlet and outlet of the switching mechanism 1003, and further controlling communication or blocking between multiple corresponding washing additive boxes 1 and a negative pressure extraction mechanism, a user can select different detergents in different washing additive boxes 1 according to requirements, and can also deliver multiple washing additive boxes 1 in a combined manner, so as to improve washing effect.

Working Process:

A user places different washing additive boxes 1 in the installation cavity of the distribution box 1002, the washing additive box is communicated with the detergent delivery pipeline, a liquid outlet of the washing additive box 1 is open, and is communicated with each inlet of the switching mechanism 1003. According to selection of the user, the control valve at the inlet of the switching mechanism 1003 is opened or closed to communicate one or more required washing additive boxes 1, and the outlet is communicated with the negative pressure pipeline of the negative pressure extraction mechanism. In a process in which water enters via the main water inlet pipeline of the washing machine, detergents in one or more washing additive boxes 1 was drawn out by the negative pressure extraction mechanism to the main water inlet pipeline, and is poured into the washing barrel via the water outlet of the water box 1001 along with water flow.

Embodiment 2

The present embodiment differs from embodiment 1 as follows: the present embodiment provides an automatic delivery system for a washing machine which includes a water box 1001, wherein the water box 1001 is provided with a water outlet 1004 communicated with the washing barrel of the washing machine, and is integrated with a main water inlet pipeline and a detergent delivery pipeline. The main water inlet pipeline is provided with multiple outlets, and the automatic delivery system further includes a distribution box 1002 arranged in the water box 1001, and the distribution box 1002 is provided with a first installation part having at least one installation cavity and a second installation part;

the automatic delivery system further includes a washing powder delivery box. The washing powder delivery box is arranged in the second installation part, and is provided with a washing powder delivery cavity, and the washing powder delivery cavity is respectively communicated with the outlet of the main water inlet pipeline and the water outlet 1004 of the water box 1001, so as to pour washing powder into a washing barrel of a washing machine. The washing powder delivery box is arranged in the second installation part, and the washing powder delivery cavity is respectively communicated with the outlet of the main water inlet pipeline and the water outlet of the water box 1001, so as to pour washing powder into a washing barrel of a washing machine.

Working Process:

A user places different washing additive boxes 1 in the installation cavity of the distribution box 1002 to communicate with the detergent delivery pipeline, the liquid outlet of the washing additive box 1 is open, and is communicated with each inlet of a switching mechanism 1003. According to selection of a user, a control valve at the inlet of the switching mechanism 1003 is opened or closed to communicate one or more required washing additive boxes 1, and the outlet is communicated with the negative pressure pipeline of the negative pressure extraction mechanism. In a process in which water enters via a main water inlet pipeline of a washing machine, a negative pressure extraction mechanism extracts detergents in one or more washing additive boxes 1 to a main water inlet pipeline, and detergents are poured into a washing barrel of a washing machine via a water outlet of a water box 1001 along with water flow. Meanwhile, water in the main water inlet pipeline also enters into the washing powder delivery box to dissolve washing powder in the washing powder delivery box, enters into the water outlet of the water box 1001 from the outlet of the washing powder delivery box and is discharged into the washing barrel. The above processes can be performed simultaneously, and can also be performed singly or in a combined manner according to requirements of the user.

Embodiment 3

The present embodiment differs from embodiment 1 as follows: the present embodiment includes a distribution box 1002 which is arranged in the water box 1001, and the distribution box 1002 is provided with a first installation part having at least one installation cavity and a second installation part;

a disposable delivery box is arranged in the second installation part, and is provided with a disposable delivery cavity 206 which is internally provided with a siphon structure. The disposable delivery cavity is communicated with the outlet of the main water inlet pipeline which is on an upstream of the disposable delivery cavity, and an outlet of the siphon structure is communicated with the water outlet 1004 of a water box 1001.

Multiple disposable delivery boxes are arranged in the second installation part, and are configured to place multiple washing additives which are not measured and delivered at a single time. The disposable delivery cavity is provided with a siphon structure, the disposable delivery cavity is communicated with the outlet of the main water inlet pipeline which is on an upstream of the disposable delivery cavity, and an outlet of the siphon structure is communicated with the water outlet 1004 of the water box 1001 to discharge washing additive to a washing barrel by relying on a siphon effect. After the Venturi tube in the main water inlet pipeline draws washing additive in the washing additive box 1, water flow can carry washing additive to enter into the disposable delivery cavity, and enter into the washing barrel via the water outlet 1004 of the water box 1001 after washing additive is mixed with liquid in the disposable delivery cavity. Or, water flow can carry extracted washing additive to directly enter into the washing barrel via the water outlet 1004 of the water box 1001.

Embodiment 4

The present embodiment differs from embodiment 1 as follows: an automatic delivery system for a washing machine in the present embodiment includes a distribution box 1002 which is arranged in the water box 1001, and the distribution box 1002 is provided with a first installation part having at least one installation cavity, a second installation part and a third installation part;

a disposable delivery box is arranged in the second installation part, and is provided with a disposable delivery cavity 206 which is internally provided with a siphon structure. The disposable delivery cavity is communicated with the outlet of the main water inlet pipeline which is on an upstream of the disposable delivery cavity, and the outlet of the siphon structure is communicated with the water outlet 1004 of the water box 1001; and a washing powder delivery box, wherein the washing powder delivery box is arranged in a second installation part and is provided with a washing powder delivery cavity, and the washing powder delivery cavity is respectively communicated with the outlet of the main water inlet pipeline and the water outlet of the water box 1001 to pour washing powder into a washing barrel of a washing machine.

One or multiple disposable delivery boxes are arranged in the second installation part, and are configured to place multiple washing additives which are not measured and delivered for a single time. The disposable delivery cavity is provided with a siphon structure, the disposable delivery cavity is communicated with the outlet of the main water inlet pipeline which is on an upstream of the disposable delivery cavity, and the outlet of the siphon structure is communicated with the water outlet of the water box 1001 to discharge washing additive to the washing barrel by relying on a siphon effect.

A washing powder delivery cavity is arranged in a third installation part, and the washing powder delivery cavity is respectively communicated with an outlet of a main water inlet pipeline and a water outlet of a water box 1001, so as to pour washing powder into a washing barrel of a washing machine.

Working Process:

A user installs different washing additive boxes in the installation cavity of the distribution box 1002, the liquid outlet of the washing additive box is open, and is communicated with each inlet of the switching mechanism 1003. According to selection of the user, the control valve at the inlet of the switching mechanism 1003 is opened or closed, so as to communicate one or more required washing additive boxes, and the outlet is communicated with a negative pressure pipeline of a negative pressure extraction mechanism. In a process in which water enters via the main water inlet pipeline of the washing machine, the negative pressure extraction mechanism draws detergents in one or more washing additive boxes to the main water inlet pipeline, and is poured into a washing barrel via the water outlet of the water box 1001 along with water flow. Meanwhile, water in the main water inlet pipeline simultaneously enters into the disposable delivery box to dilute detergent in the disposable delivery cavity, and diluted detergent enters into the water outlet of a water box 1001 via the outlet of the siphon structure under the effect of siphon and is discharged into the washing barrel. Or, water in the main water inlet pipeline simultaneously enters into the washing powder delivery box to dissolve washing powder in the washing powder delivery box, enters into a water outlet of a water box 1001 from the outlet of the washing powder delivery box and is discharged into the washing barrel. The above processes can be performed simultaneously, and can also be performed singly or in a combined manner according to requirements of the user.

Embodiment 5

As shown in FIG. 7 to FIG. 14, the present embodiment further defines embodiment 1. The present embodiment provides an automatic delivery system for a washing machine. A washing additive box 1 includes a closed box body which is internally provided with a cavity. The box body is provided with a liquid outlet for communicating the box body and a switching mechanism 1003. And the box body is provided with a unidirectional ventilation structure for balancing air pressure inside and outside the washing additive box 1. The washing additive box 1 is internally provided with a liquid outlet device. The washing additive is arranged in the cavity inside the box body, enters into the switching mechanism 1003 from the liquid outlet through the liquid outlet device, then enters into the detergent delivery pipeline under the effect of the negative pressure extraction mechanism, and enters into the washing barrel of the washing machine from the water outlet of the water box 1001 along with water flow to assist in washing.

Multiple washing additive boxes 1 in the present embodiment are sealed closed box bodies which are internally provided with a cavity, and are provided with a liquid outlet. Washing additive is arranged in the cavity inside the box body. When the switching mechanism 1003 is communicated with the liquid outlet of the washing additive box 1, the negative pressure extraction mechanism draws washing additive in the washing additive box 1, and the washing additive enters into the main water inlet pipeline from the liquid outlet through the liquid outlet device. In the extracting process, air pressure inside and outside the washing additive box 1 is balanced by the ventilation structure, such that extraction is always kept smooth.

In the present embodiment, the air pressure difference between the inner and the outer of the washing additive box 1 makes the unidirectional ventilation structure be open for unidirectional air permeability, or makes the unidirectional ventilation structure be close to seal the washing additive box 1. The unidirectional ventilation structure only allows unidirectional air permeability of the box body, while liquid, impurities and the like cannot pass through the unidirectional ventilation structure to flow inside and outside the washing additive box 1. Therefore, the unidirectional ventilation structure plays a role of scaling the box body while ensuring unidirectional air permeability.

Specifically, the unidirectional ventilation structure includes an ventilation element 21 and a switching element 22, the ventilation element 21 is provided with a venting hole 211, the switching element 22 includes a switching part 221. The switching part 221 is opened or closed under the air pressure difference between the inner and the outer of the washing additive box 1, and the venting hole 211 is ventilation unidirectionally or is closed.

The ventilation element 21 is provided with two venting holes 211, the venting holes 211 penetrate through an upper and a lower end face of the ventilation element 21, and air outlets of the venting hole 211 are distributed uniformly on the lower end face along a circumferential direction. The venting holes are set to realize air permeability, and the venting holes are preferably distribution uniformly along a circumferential direction to prevent overlarge opening of part of the switching part which may lead to incapability of reset of the switching part and closing of the venting hole due to non-uniform distribution.

The ventilation element 21 is formed by two cylindrical structures which are co-axial with different diameters and which are molded in one body, and a diameter of an upper end face is slightly bigger than a diameter of a lower end face. The ventilation element 21 is further co-axially provided with a connecting hole 212 which connects the switching element 22 and an annular groove 213 which assists in sealing the switching element 22.

The connecting hole 212 penetrates through the ventilation element 21 and is coaxial with the ventilation element 21. The connecting hole 212 includes two holes which are co-axial with different diameters, and a clamping boss 2121 configured to clamp the switching element 22 is formed at a connecting point between the two holes. The venting holes 211 are uniformly arranged along a circumferential direction around an axis of the connecting hole 212, to prevent complete opening of the switching part which cannot be closed and reset due to non-uniform distribution of venting holes.

The annular groove 213 is arranged on the lower end face of the ventilation element 21, and an air outlet of the venting hole 211 is arranged on the lower end face inside the annular groove 213. An inner side wall of the annular groove 213 is set to be inclined towards the direction of the venting hole 211, and extends transitionally to an outer edge of the venting hole 211. An outer side wall of the annular groove 213 is a vertical side. The inner side wall and the outer side wall are intersected in a smooth manner, thereby improving sealing effect with the switching part.

The switching element 22 is an elastic material element which is molded in one body, and includes a switching part 221 and a connecting part 222. The switching part 221 is of an inverted umbrella-type structure, and covers on the lower end face of the ventilation element 21, and a tail end of the switching part 221 extends into the annular groove 213. When the switching part 221 is closed, a tail end extends into the annular groove 213 to seal the venting hole 211. When the switching part 221 is open, the switching part 221 is deformed, and a tail end departs from the annular groove 213, and a venting hole 211 is air permeable unidirectionally.

The switching part is an inverted umbrella-type structure or a conical structure, such that the switching part is deformed only under a certain unidirectional pressure, and has a favorable force in restoring deformation due to reasons of its own structure after deformation.

The connecting part 222 is provided with an annular boss 2221 and a transition segment 2222. The annular boss 2221 is in match with the clamping boss 2121 on the connecting hole 212 to clamp the connecting part 222 in the connecting hole 212. The transition segment 2222 is arranged between the annular boss 2221 and the switching part 221, and the transition segment 2222 is internally provided with a hollow hole 2223 which assists in deformation of the switching part 221.

Preferably, the section of the annular boss 2221 is semicircle; the hollow hole 2223 arranged inside the transition segment 2222 extends into and penetrates through the switching part 221, so as to further reduce force required by deformation of the switching part 221.

The washing additive box 1 in the present embodiment includes the liquid outlet 12, and further includes the above unidirectional ventilation structure 2. The washing additive box 1 has two states: washing additive is extracted from the liquid outlet 12, air pressure in the washing additive box 1 is reduced, the air pressure in the washing additive box 1 is smaller than external air pressure, the switching part 221 is deformed, and a tail end departs from the annular groove 213, and the venting hole 211 is air permeable. A second state is that extraction is stopped, the liquid outlet 12 is sealed, air pressure in the washing additive box 1 is equal to external air pressure, the switching part 221 restores to its original state, and the tail end of the switching part 221 extends into the annular groove 213 to seal the washing additive box 1.

Embodiment 6

The present embodiment further defines embodiment 1, and the present embodiment provides an automatic delivery system for a washing machine. A washing additive box 1 includes a closed box body which is internally provided with a cavity, the box body is provided with a liquid outlet 12. The liquid outlet 12 is communicated the box body and the detergent delivery pipeline. And the box body is provided with a unidirectional ventilation structure for balancing air pressure inside and outside the washing additive box. The washing additive box is internally provided with a liquid outlet device, the washing additive is arranged in the cavity inside the box body, enters into a detergent delivery pipeline from a liquid outlet through a liquid outlet device under the effect of a negative pressure extraction mechanism, and enters into a main water inlet pipeline or other pipelines and enters into a washing barrel.

Figure 15:
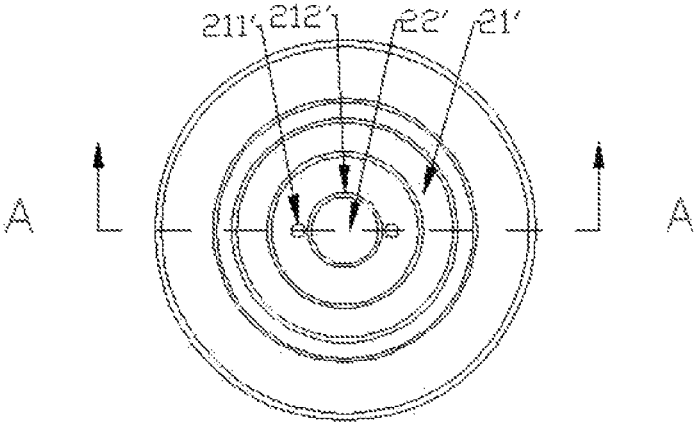
FIG. 15 is a schematic diagram of a top view of a unidirectional ventilation structure (referring to a liquid inlet cover) in embodiment 3.
Figure 16:
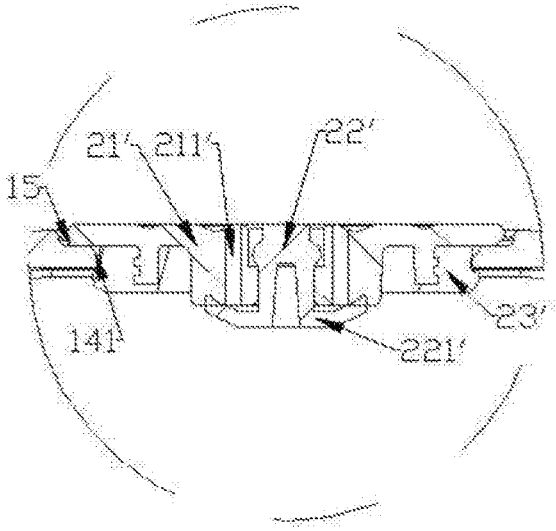
FIG. 16 is a partially enlarged section view of a unidirectional ventilation structure (referring to a liquid inlet cover) in embodiment 3.
Figure 17:
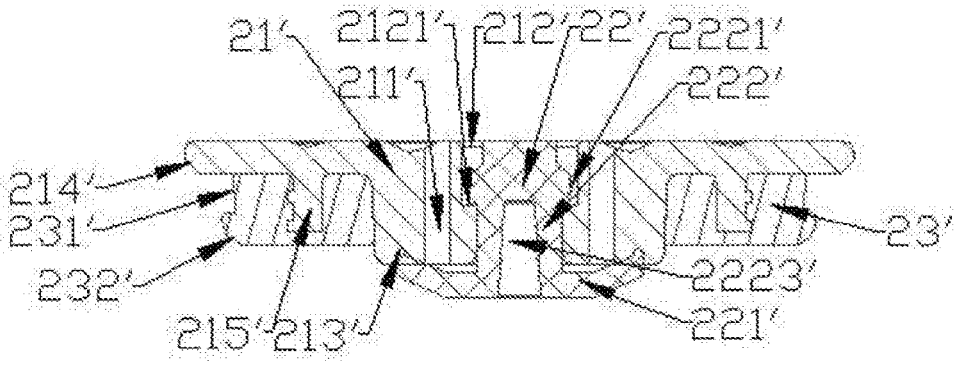
FIG. 17 is a section view of a unidirectional ventilation structure (referring to a liquid inlet cover) in embodiment 3.

As shown in FIGS. 15-17, in the present embodiment, the washing additive box 1 is provided with a liquid inlet cover 2'. The washing additive box 1 includes a box body and a liquid inlet 14, the liquid inlet 14 is detachably arranged with a liquid inlet cover 2', and the liquid inlet cover 2' is a unidirectional ventilation structure.

In the present embodiment, a liquid inlet cover is detachably arranged, then washing additive can be added to the washing additive box through the liquid inlet, such that the washing additive box can be recycled, thereby saving cost, saving energy and protecting environment, and facilitating use. An unidirectional ventilation structure allows unidirectional flow of gas, and can balance air pressure in the washing additive box, such that the detergent can be drawn out more smoothly, and the difficulty in extracting detergent will not be increased due to reduced pressure in the washing additive box. Meanwhile, gas and liquid cannot flow out from the washing additive box, thereby playing a role of sealing, waterproofness, dustproofness and preventing overflow of liquid.

The unidirectional ventilation structure includes a cover body and a switching element 22', the cover body is provided with two venting holes 211', the switching element 22' includes a switching part 221', the switching part 221' is opened or closed under an air difference between the inner and the outer of the washing additive box 1, and the venting hole 211' is ventilation unidirectionally or close.

The cover body is provided with at least one venting hole 211', the venting hole 211' penetrates through an upper and a lower end face of the cover body, and air outlets of the venting hole 211' are distributed uniformly on a lower end face along a circumferential direction.

The cover body includes a first cover body 21' for rigidly supporting and a second cover body 23' for flexibly supporting, and the second cover body 23' is sheathed on a lower end of the first cover body 21', and is in match with the first cover body 21' to install a liquid inlet cover 2' on a liquid inlet 14 in a detachable and sealed manner.

The first cover body 21' and the second cover body 23' are made of two materials, and the first cover body 21' and the second cover body 23' are molded in a clamping manner.

The first cover body 21' is composed of two cylindrical structures with different diameters, the diameters of an upper end of the cylindrical structures are larger than the diameter of a lower end. The second cover body 23' is sheathed on the lower end of the first cover body 21', and the diameter of an upper end of the first cover body 21' is larger than the diameter of the second cover body 23'.

A side wall of the second cover body 23' is provided with a groove 231' which is clamped with the liquid inlet 14 of the box body, and an outer side of a bottom part of the second cover body 23' is further provided with a transition part 232' which facilitates installation.

The groove 231' is in match with the liquid inlet 14, to clamp a liquid inlet cover 2' on the liquid inlet 14 in a sealed manner. And the transition part 232' which is arranged on an outer side of the bottom part to facilitate installation is an inclined surface which extends outwards from the bottom part.

A bottom part of a side wall at an upper end of the first cover body 21' is provided with a concave part 214' which is suitable for hand buckling, and the concave part 214' is a flat concave part 214' formed when a side wall of the first cover body 21' inclines towards the bottom part.

The second cover body 23' is an elastic material element which is molded in one body, a lower end of the first cover body 21' is provided with a non-smooth connecting part 215', and the connecting part 215' is in match with the second cover body 23' to enhance connecting strength between the first cover body 21' and the second cover body 23'.

The first cover body 21' is provided with two venting holes 211' which penetrate through an upper and a lower end face of the first cover body 21', and is co-axially provided with a connecting hole 212' which connects a switching element 22' and an annular groove 213' which assists in sealing the switching element 22'. The annular groove 213' is arranged on a lower end face of the first cover body 21', and an air outlet of the venting hole 211' is arranged on a lower end face in the annular groove 213'.

Air outlets of the venting holes 211' are uniformly distributed on a lower end face of the first cover body along a circumferential direction.

The connecting hole 212' and the annular groove 213' are co-axially arranged, and the venting holes 211' are uniformly arranged in a circumferential direction around an axis of the connecting hole 212'.

A clamping boss 2121' which clamps the switching element 22' is formed inside the connecting hole 212'.

Preferably, an inner side wall of the annular groove 213' is set to be inclined towards the direction of the venting hole 211', more preferably, the inner side wall of the annular groove 213' is inclined and extends transitionally to an outer edge of the venting hole 211', to improve a sealing effect with the switching part 221'.

The box body is provided with an installation concave part 15 for installing a liquid inlet cover 2' and a hand buckling position 16. The installation concave part 15 extends outwards from a liquid inlet 14, and the shape of the installation concave part 15 is in match with an upper end of the first cover body 21'. The hand buckling position 16 is a semicircle installation concave part 15 which is formed when one end of the installation concave part 15 extends outwards additionally. The liquid inlet 14 is further provided with a guide part 141 which facilitates installation of the liquid inlet cover 2', and the guide part 141 is in match with the transition part 232' of the second cover body 23'.

The switching element 22' is an elastic material element which is molded in one body, and includes a switching part 221' and a connecting transition segment 222' which connects the connecting hole 212' of the first cover body 21'.

The switching part 221' is of an inverted umbrella-type structure or a conical structure, and covers on a lower end face of a first cover body 21', the switching part 221' keeps its original shape or is deformed, such that a tail end of the switching part 221' stretches into or departs from the annular groove 213', so as to close or open the venting hole 211'. And the connecting transition segment 222' is internally provided with a hollow hole 2223' which assists in deformation of the switching part 221'.

The switching part 221' of the switching element 22' is made of elastic materials, and the switching part 221' and the connecting part 215' are molded in one body. The switching part 221' is set to be of an inverted umbrella-type structure.

The switching part 221' is closed, a tail end extends into an annular groove 213' to seal the venting hole 211'. The switching part 221' is open, the switching part 221' is deformed, and the tail end departs from the annular groove 213', and the venting hole 211' is air permeable unidirectionally.

The connecting transition segment 222' is provided with an annular boss 2221' and a transition segment, the annular boss 2221' is in match with a clamping boss 2121' on the connecting hole 212' to clamp the connecting part 215' in the connecting hole 212'. The section of the annular boss 2221' is semicircle; and a hollow hole 2223' is arranged inside the connecting transition segment 222' and extends into and penetrates through the switching part 221'.

A washing additive box 1 provided with a liquid inlet cover 2' includes a liquid outlet 12. The washing additive box 1 has two states: a first state is that washing additive is extracted from a liquid outlet 12, air pressure in the washing additive box 1 is reduced, air pressure in the washing additive box 1 is smaller than external air pressure, a switching part 221' is deformed, and a tail end of the switching part 221' departs from an annular groove 213', and air enters through a venting hole 211'. A second state is that extraction is stopped, a liquid outlet 12 is scaled, air pressure in the washing additive box 1 is equal to external air pressure, a switching part 221' restores to its original state, and a tail end of the switching part 221' extends into an annular groove 213' to seal the washing additive box 1.

Embodiment 7

As shown in FIGS. 9-11 and FIGS. 18-19, the present embodiment further defines embodiment 1. The present embodiment provides an automatic delivery system for a washing machine. The washing additive box in the automatic delivery system includes a closed box body which is internally provided with a cavity, the box body is provided with a liquid outlet, the liquid outlet is communicated with the box body and the detergent delivery pipeline. And the box body is provided with a unidirectional ventilation structure for balancing air pressure inside and outside the washing additive box. The washing additive box is internally provided with a liquid outlet device, the washing additive is placed in a cavity inside the box body, under the effect of a negative pressure extraction mechanism, the washing additive enters into the detergent delivery pipeline from the liquid outlet through the liquid outlet device, and further enters into a main water inlet pipeline and enters into a washing barrel.

The liquid outlet device includes an on-off valve arranged on the liquid outlet 12 and a suction device arranged in the washing additive box. An inlet of the suction device is communicated with the washing additive box, and an outlet is communicated with an inlet of the on-off valve.

The washing additive box 1 of the present embodiment can be set to be of two structures. The first structure is as follows: refer to FIG. 9 to FIG. 11, the liquid outlet 12 is arranged on a side wall, the washing additive box 1 is of a cuboid or square box body structure. Preferably, the washing additive box 1 is of a cuboid structure, the liquid outlet 12 is arranged on a side wall, and the side wall is in sealed connection with the main body of a box body. The on-off valve 5 can be set to be integrated with the side wall, and an inlet of the on-off valve 5 is in sealed communication with an outlet of the suction device 3. The second structure is as follows: refer to FIG. 18, the washing additive box is of a regular cuboid structure, the liquid outlet 12 is arranged on a bottom wall, the on-off valve 5 is set to be integrated with a bottom wall. The on-off valve 5 is vertically arranged, while one end of the suction device 3 is set to face a bottom wall, and the other end turns twice, an outlet of the suction device 3 is in scaled communication with an inlet of the on-off valve 5. An outwardly extended arc surface corresponds to a reversing point of an inlet of an on-off valve 5 on the flow channel. The outwardly extended arc surface corresponding to a reversing point of an inlet of an on-off valve 5 on the flow channel is beneficial for flow of washing additive in the flow channel, relative to the adoption of a right angle or an intersection angle similar to a right angle at the diversion point, in the present disclosure, an outwardly extended arc surface at the reversing point is beneficial for flow of liquid, rather than generating intermittent flow. Preferably, two turning points in the flow channel are both outwardly extended arc surfaces.

Figure 18:
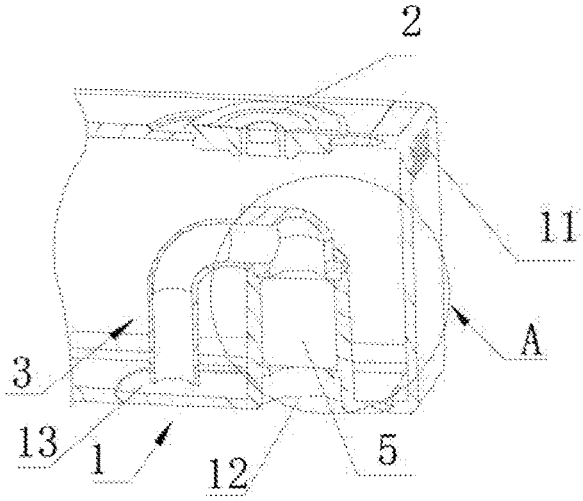
FIG. 18 is a schematic diagram of an internal structure of a washing additive box.
Figure 19:
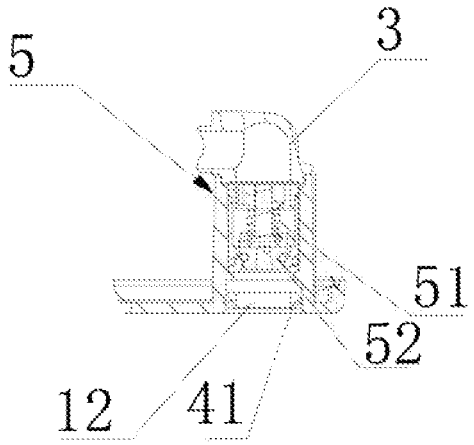
FIG. 19 is an enlarged view of part A of an internal structure of a washing additive box in FIG. 18.

In a first solution, as shown in FIG. 18 to FIG. 19, the suction device 3 extends towards a bottom wall of the washing additive box 1, the inlet of the suction device 3 is set to face the bottom wall of the washing additive box 1, and a gap for liquid to pass through is reserved between the inlet of the suction device 3 and the bottom wall.

In the present embodiment, a suction device 3 is arranged. An inlet of the suction device 3 is set to face the bottom wall of the washing additive box 1, and a gap for liquid to pass through is reserved between the inlet of the suction device 3 and the bottom wall, so as to completely extract washing additive in the washing additive box 1 and cause no waste. Preferably, a groove 13 with the position being lower than a surface of a bottom wall of the washing additive box 1 is formed in a concave manner, corresponding to the inlet of the suction device 3, on a bottom wall of the washing additive box 1, the inlet of the suction device 3 is arranged in the groove 13, and a gap for liquid to pass through is reserved between the inlet of the suction device 3 and a bottom surface and a side wall of the groove 13. In the present embodiment, a groove 13 with the position being lower than the surface of the bottom wall of the washing additive box 1 is formed in a concave manner, corresponding to the inlet of the suction device 3, on the bottom wall, when little washing additive remains, the groove plays a role of clustering washing additive, and an inlet of the suction device 3 is arranged in the groove 13, thereby sufficiently utilizing washing additive, saving to the greatest extent, and causing no waste.

Further, the suction device 3 is a hollow tubular structure, a flow channel is formed inside the suction device 3, one end of the flow channel faces a bottom wall of the washing additive box 1, and the other end is communicated with an inlet of the on-off valve 5. The flow channel forms a diversion channel of cambered shape between an inlet and an outlet, and a diversion point of the flow channel corresponding to the inlet of an on-off valve is an outwardly extended arc surface. Preferably, the radius of the arc surface is larger than the radius of the flow channel. The outwardly extended arc surface corresponding to a reversing point of the inlet of the on-off valve 5 on the flow channel is beneficial for flow of washing additive in the flow channel, relative to the adoption of a right angle or an intersection angle similar to a right angle at the diversion point. In the present disclosure, an outwardly extended arc surface at the reversing point is beneficial for flowing of liquid, rather than generating intermittent flow.

Preferably, the on-off valve 5 includes drainage channel and a piston 52 and a reset spring 51 which arc arranged in the drainage channel, and the piston 52 blocks the drainage channel under the effect of the reset spring 51.

Preferably, the on-off valve 5 includes a drainage channel and a piston 52 arranged in the drainage channel, a gap for liquid to flow is reserved between an outer wall of the piston 52 and an inner wall of the drainage channel, the drainage channel is provided with a narrowing segment at an end of an outlet, and the piston 52 is extruded on the narrowing segment under the effect of a reset spring 51, to seal the drainage channel.

Preferably, the liquid outlet 12 is configured to communicate to the detergent delivery pipeline of the washing machine to deliver washing additive to the washing barrel of the washing machine. And the washing additive pipeline, or a switching mechanism, or a negative pressure pipeline is provided with a communicating structure which is configured to open the on-off valve 5 when a liquid outlet 12 is communicated with the detergent delivery pipeline or the switching mechanism on the detergent delivery pipeline or the negative pressure pipeline.

In the present embodiment, the communicating structure can be a protruding structure or can be provided with a protruding structure, the protruding structure can stretch into the liquid outlet 12 and be in match with the piston 52. The protruding structure pushes open the piston 52, that is, the protruding structure opens the on-off valve 5.

Preferably, the communicating structure is arranged at an end part of the detergent delivery pipeline or the switching mechanism, and opens the on-off valve 5 through pushing open the piston 52. A seal ring 41 is arranged at the liquid outlet 12 or in the diversion channel of the on-off valve 5, and is configured to seal a connecting point between the liquid outlet 12 and the detergent delivery pipeline or the switching mechanism.

In the above solution, the communicating structure is a cylindrical structure, a flow channel is formed inside the communicating structure. One end of the communicating structure is configured to be in match with the washing additive box 1 to open the on-off valve 5, while the other end is configured to communicate with the switching mechanism 1003 of the washing machine. A side wall of an end configured to be in match with a washing additive box 1 is formed with an opening for communicating with a flow channel inside the communicating structure, therefore, when the end part pushes open the piston 52, the opening guides washing additive to a flow channel inside the communicating structure, and then the washing additive enters into a washing machine via a detergent delivery pipeline.

Preferably, the washing additive box 1 is of a square or cuboid structure, and the liquid outlet 12 is set to be flush with an outer surface of the washing additive box 1. Of course, the liquid outlet 12 can also protrude out of the surface of the washing additive box 1. In order to reduce processing difficulty and simplify the installation cavity structure which accommodates the washing additive box 1, the washing additive box 1 is optimally designed to be a regular square or cuboid, while the liquid outlet 12 and the outer surface of the washing additive box 1 are set to be flush with each other.

In a second solution, the liquid outlet 12 of the washing additive box 1 is arranged on the side wall of the washing additive box 1. The washing machine is provided with a water box, the water box is internally provided with a distribution box which can be extracted out or pushed in, the distribution box is provided with an installation cavity, and the washing additive box 1 is installed in the installation cavity. The water box is internally provided with a communicating structure, such that when the distribution box is pushed into the water box, the communicating structure opens the on-off valve 5 and communicates the cavity with the detergent delivery pipeline.

The liquid outlet 12 is arranged at a bottom of the side wall, and the suction device 3 is a hollow tubular structure which is arranged horizontally. The liquid outlet 12 is arranged at the bottom of a side wall, which is beneficial for the suction device 3 to sufficiently absorb washing additive in the washing additive box 1.

Or, the liquid outlet 12 is arranged at any position of the side wall, the suction device 3 is a hollow tubular structure with an inlet end being bent towards a side of a bottom wall of the washing additive box 1, an inlet of the suction device 3 faces the bottom wall, a gap for liquid to pass through is reserved between the inlet and the bottom wall. In the solution, the inlet of the suction device 3 faces the bottom wall, and a gap for liquid to pass through is reserved between the inlet and the bottom wall. The gap is as small as possible, and this is beneficial for the suction device 3 to sufficiently absorb washing additive in the washing additive box 1.

Embodiment 8

Figure 20:
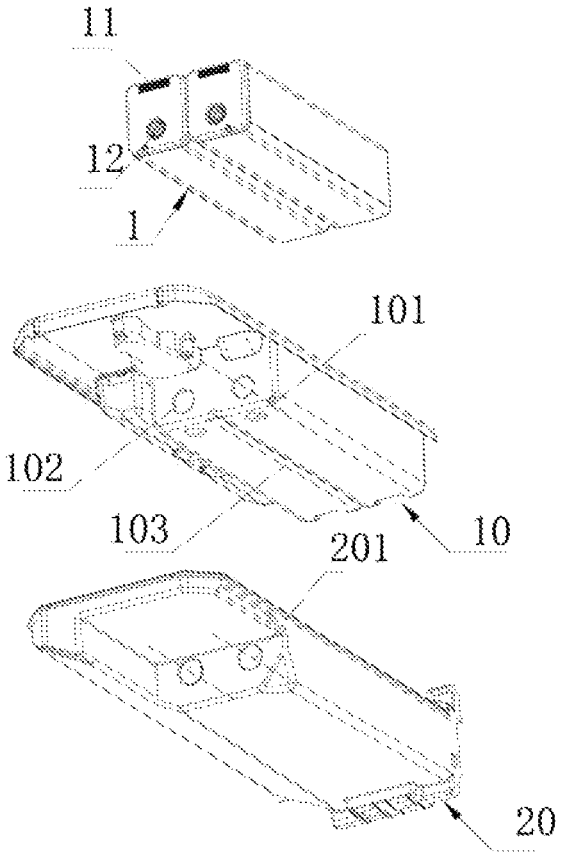
FIG. 20 is an exploded view of a bottom view of an installation structure of a washing additive box and a distribution box in the present disclosure.
Figure 21:
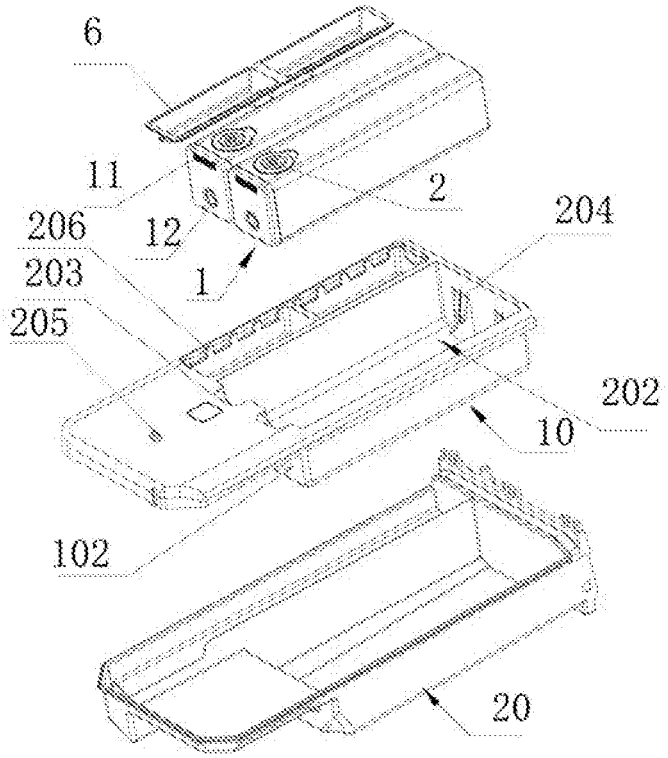
FIG. 21 is an exploded view of a top view of an installation structure of a washing additive box and a distribution box in the present disclosure.
Figure 22:
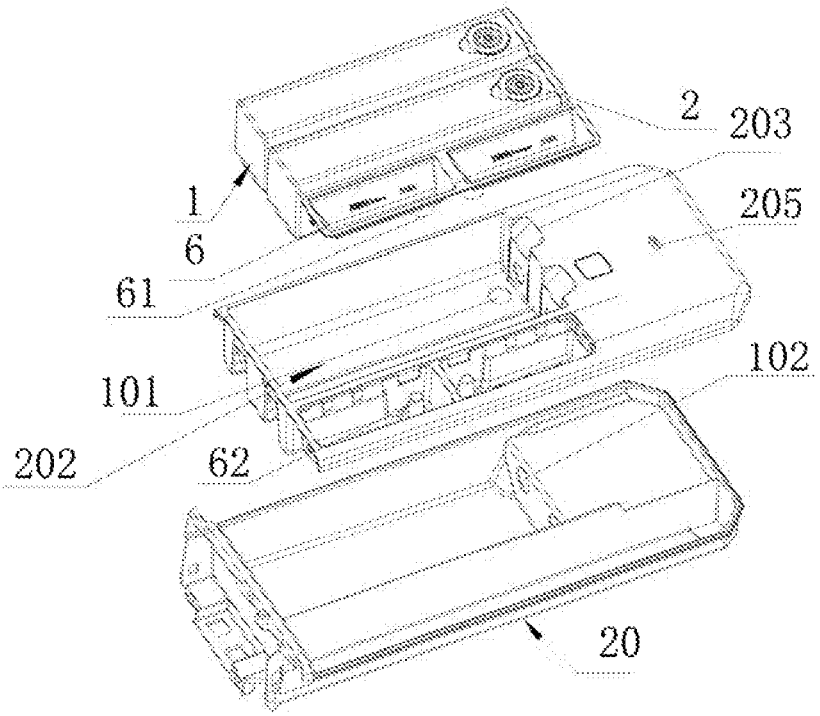
FIG. 22 is an exploded view of a front top view of an installation structure of a washing additive box and a distribution box in the present disclosure.

Refer to FIGS. 20-22, the present embodiment further defines embodiment 1. A distribution box of an automatic delivery system for a washing machine in the present embodiment can be extracted from or pushed into the water box of the washing machine. The distribution box is internally provided with an installation cavity 202 for placing at least one washing additive box. The washing additive box 1 is a closed box body structure which is internally provided with a cavity for placing washing additive, the washing additive box is provided with an unidirectional ventilation valve 2 and a liquid outlet 12, and the liquid outlet 12 is provided with an on-off valve 5.

The washing additive box 1 is further internally provided with a suction device 3, an inlet of the suction device 3 is communicated with the cavity, and an outlet of the suction device 3 is communicated with an inlet of the on-off valve 5.

Wherein the suction device 3 extends towards a bottom wall of the washing additive box 1, the inlet of the suction device 3 is set to face the bottom wall of the washing additive box 1, and a gap for liquid to pass through is reserved between the inlet of the suction device 3 and the bottom wall.

In the present embodiment, the suction device 3 is arranged. The inlet of the suction device 3 is set to face a bottom wall of the washing additive box 1, and a gap for liquid to pass through is reserved between the inlet of the suction device 3 and the bottom wall, so as to completely extract washing additive in the washing additive box 1 and cause no waste. Preferably, a groove 13 with the position being lower than a surface of a bottom wall of the washing additive box 1 is formed in a concave manner, corresponding to the inlet of the suction device 3. On a bottom wall of the washing additive box 1, the inlet of the suction device 3 is arranged in the groove 13, and a gap for liquid to pass through is reserved between the inlet of the suction device 3 and the bottom surface and the side wall of the groove 13. In the present embodiment, the groove 13 with the position being lower than a surface of a bottom wall of the washing additive box 1 is formed in a concave manner, corresponding to the inlet of the suction device 3, on the bottom wall, when little washing additive remains, the groove plays a role of clustering washing additive, and an inlet of the suction device 3 is arranged in the groove 13, thereby sufficiently utilizing washing additive, saving to the greatest extent, and causing no waste.

Further, the suction device 3 is a hollow tubular structure, a flow channel is formed inside the suction device 3. One end of the flow channel faces a bottom wall of the washing additive box 1, and the other end is communicated with an inlet of the on-off valve 5. The flow channel forms a diversion channel of cambered shape between an inlet and an outlet, and a diversion point of the flow channel corresponding to the inlet of an on-off valve is an outwardly extended arc surface; preferably, the radius of the are surface is larger than the radius of the flow channel. The outwardly extended arc surface corresponding to a reversing point of the inlet of the on-off valve 5 on the flow channel is beneficial for flow of washing additive in the flow channel, relative to the adoption of a right angle or an intersection angle similar to a right angle at the diversion point, in the present disclosure, an outwardly extended arc surface at the reversing point is beneficial for flow of liquid, rather than generating intermittent flow.

Preferably, the on-off valve 5 includes a diversion channel and a piston 52 and a reset spring 51 which are arranged in the diversion channel, and the piston 52 blocks the diversion channel under the effect of the reset spring 51.

Preferably, the on-off valve 5 includes the drainage channel and the piston 52 arranged in the drainage channel, a gap for liquid to flow is reserved between an outer wall of the piston 52 and an inner wall of the drainage channel. The drainage channel is provided with a narrowing segment at an end of an outlet, and the piston 52 is extruded on the narrowing segment under the effect of a reset spring 51, to seal the drainage channel.

Preferably, the liquid outlet 12 is configured to communicate a switching mechanism of an automatic delivery system for the washing machine, so as to pour washing additive to the washing barrel of the washing machine, namely, an inner barrel, and the switching mechanism is provided with a communicating structure which is configured to open the on-off valve 5 when the liquid outlet 12 is communicated with the switching mechanism.

The communicating structure can be a protruding structure or can be provided with a protruding structure, the protruding structure is horizontally arranged in the water box, and is corresponding to the position of the liquid outlet 12 of the washing additive box. When the distribution box is pushed into a water box, the distribution box can be stretched into the liquid outlet 12 to be in match with the piston 52. The protruding structure pushes open the piston 52, that is, the protruding structure opens the on-off valve 5.

Preferably, the communicating structure is arranged at an end part of the switching mechanism, and opens the on-off valve 5 through pushing open the piston 52. A seal ring 41 is arranged at the liquid outlet 12 or in the diversion channel of the on-off valve 5, and is configured to seal a connecting point between the liquid outlet 12 and the switching mechanism.

In the above solution, the communicating structure is a cylindrical structure, and is horizontally arranged in the water box, a flow channel is formed in the communicating structure, one end of the communicating structure is configured to be in match with the washing additive box 1 to open the on-off valve 5, while the other end is configured to communicate with a switching mechanism in a water box. A side wall of an end configured to be in match with the washing additive box 1 is formed with an opening for communicating with a flow channel inside the communicating structure. Therefore, when the end part pushes open the piston 52, the opening guides washing additive to a flow channel in the communicating structure, and then the washing additive enters into a washing machine via a switching mechanism.

Preferably, the washing additive box 1 is of a square or cuboid structure, and the liquid outlet 12 is set to be flush with an outer surface of the washing additive box 1. Of course, the liquid outlet 12 can also protrude out of the surface of the washing additive box 1. In order to reduce processing difficulty and simplify the installation cavity structure which accommodates the washing additive box 1, the washing additive box 1 is optimally designed to be a regular square or cuboid, while the liquid outlet 12 and an outer surface of the washing additive box 1 are set to be flush with each other, thereby simplifying structure of the installation cavity 202 on a distribution box, and the installation cavity can also be set to be of a regular square or cuboid shape, thereby reducing processing complexity.

The liquid outlet 12 is arranged at a bottom of the side wall of the washing additive box, and the suction device 3 is a hollow tubular structure which is arranged horizontally, wherein the liquid outlet 12 is arranged at the bottom of the side wall, which is beneficial for the suction device 3 to sufficiently absorb washing additive in the washing additive box 1.

Or, the liquid outlet 12 is arranged at any position of the side wall, the suction device 3 is a hollow tubular structure with an inlet end being bent towards a side of a bottom wall of a washing additive box 1, an inlet of the suction device 3 faces the bottom wall, a gap for liquid to pass through is reserved between the inlet and the bottom wall. In the solution, the inlet of the suction device 3 faces the bottom wall, and a gap for liquid to pass through is reserved between the inlet and the bottom wall. The gap is as small as possible, and this is beneficial for the suction device 3 to sufficiently absorb washing additive in the washing additive box 1.

Further, at least one placing space for placing a washing additive box 1 is defined inside the installation cavity 202, and the installation cavity 202 is provided with a limit structure which is configured to limit movement of the washing additive box 1 when the washing additive box 1 is arranged on an installation cavity.

The limit structure includes an elastic piece 204 arranged at one side of the installation cavity and configured to be arranged between the washing additive box 1 and the side wall of the installation cavity 202 in an elastically deformed manner when the washing additive box 1 is arranged on the installation cavity 202. Preferably, the washing additive box is of a cuboid structure, and the elastic piece is arranged along a length direction of the washing additive box. In the above solution, the elastic piece 204 can fix the washing additive box, and can play a buffering effect on the washing additive box when the washing machine vibrates. Preferably, the elastic piece can be molded in one body with the distribution box, thereby simplifying structure.

Preferably, multiple washing additive boxes 1 are arranged in the installation cavity 202 in a mutually parallel manner. The limit structure further includes at least one separating rib 103 which are arranged on a bottom wall of the installation cavity 202, and the separating rib 103 is configured to separate each washing additive box 1 to form at least two placing spaces for placing the washing additive boxes 1.

In the above solution, the separating rib 103 can define movement of the washing additive box, and can simultaneously divide the installation cavity into multiple different placing spaces. Through such a setting, even if the number of washing additive box is smaller than the number of placing space, when the washing additive box is arranged inside the installation cavity, the washing additive box will also be limited by the separating rib, and the separating rib has an effect of fixing the washing additive box.

Preferably, the separating rib 103 and the elastic piece are set in a homonymous manner, the separating rib 103 limits movement of the washing additive box 1 in a first direction, and the elastic piece 204 limits movement of the washing additive box 1 in a second direction vertical to the first direction.

In the above solution, each placing space is respectively provided with an elastic piece, the elastic piece and the separating rib are arranged in a homonymous manner, and are arranged between two adjacent separating ribs. Since the limiting directions of the elastic piece and the separating rib are different, a washing additive box 1 can be stably limited inside the installation cavity.

Preferably, a hand buckling position 203 is arranged on a side wall relative to an elastic piece on the installation cavity 202;

preferably, the hand buckling position 203 is a concave part which is formed when a side wall of an installation cavity 202 extends outwards.

In the above solution, the design of a hand buckling position 203 is beneficial for detaching the washing additive box. The hand buckling position is arranged on a side opposite to the elastic piece 204, thereby facilitating detachment of a washing additive box 1. Based on the structural design, in a detaching process, a user can break off the washing additive box at a hand buckling position towards the elastic piece 204, then the elastic piece will be subjected to elastic deformation, such that the washing additive box has a movable space, at this time, the washing additive box can be taken off under an upward force.

A protruding structure 11 for increasing a friction force is arranged, corresponding to a hand buckling position, on the washing additive box 1.

The setting of the protruding structure further facilitates detachment of a user, preferably, the protruding structure is multiple convex ribs which are arranged in parallel on a side surface of a washing additive box.

Further, the distribution box includes an upper box 10 and a lower box 20 which are set in a detachable or integrated manner. The lower box 20 is provided/connected with a diversion structure which is communicated to the outer barrel of the washing machine. The installation cavity 202 is arranged on the upper box 10, and a bottom wall of the installation cavity 202 is formed with a through hole 101 which is communicated to the lower box 20. The setting of the through hole 101 facilitates uses in cleaning the installation cavity 202, since in long-term use, liquid may leak out at a liquid outlet 12 of the washing additive box 1. At this time, the installation cavity 202 can be washed with water, water after washing can enter into the lower box 20 via the through hole 101, thereby achieving an object of cleanness. The communicating structure is arranged in the water box, an evading opening 102 is formed, relative to the liquid outlet 12, in the installation cavity 202 of the upper box 10. Meanwhile, an evading opening 201 is also arranged, corresponding to the evading opening 102, on the lower box. Through such a structure, when the distribution box is pushed into a water box, the communicating structure arranged on the water box penetrates through the evading opening 201 and the evading opening 102 in sequence and is in match with the liquid outlet, so as to open the on-off valve and communicate the cavity and the switching mechanism. The water box is also provided with a negative pressure generator which is configured to extract liquid in the washing additive box into the washing machine. Preferably, the upper box 10 is further provided with a stopping part 205 which is configured to be in match with a water box of a washing machine and limit a distribution box from departing from the water box.

In the above solution, the through hole 101 is designed to facilitate cleaning the inner side of the installation cavity 202. When a washing additive box is arranged on the distribution box, since the distribution box is often drawn, a small amount of washing additive may leak out, then after the installation cavity is used for a period of time, when leaked washing additive is found in the installation cavity 202, the installation cavity 202 can be washed with water, then water containing washing additive after cleaning will flow into the lower box via the through hole, and then flows into the washing machine via the lower box. Of course, when an installation cavity 202 is cleaned, cleaning can be performed before washing clothes, so as to sufficiently utilize the leaked washing additive, thereby playing a role of saving.

Preferably, the upper box is further provided with a disposable delivery cavity 206, and the disposable delivery cavity 206 is internally provided with a siphon structure.

In the above solution, the distribution box can be again provided with a disposable delivery cavity 206, such that as to the distribution box of the present disclosure, washing additives are not limited to delivery through a washing additive box 1, and can also be singly delivered and used directly through a disposable delivery cavity 206. When a user only needs to use one detergent for a single washing, and is not certain whether the same detergent will be used for the next time, the user can pour the washing additive to a disposable delivery cavity 206 to complete washing for a single time, thereby being simple and speedy.

Preferably, the disposable delivery cavity is set to be adjacent to the installation cavity 202, an open end of the disposable delivery cavity 206 is further provided with a delivery funnel 6, and an outlet of the delivery funnel 6 is set to be opposite to the opening of the disposable delivery cavity 206.

Preferably, the delivery funnel 6 is clamped on a top part of the disposable delivery cavity through a buckling structure. A diversion wall is arranged on the delivery funnel from an opening to a bottom part, the bottom part of the diversion wall is provided with the opening. And the diversion wall is a structure which inclines towards inner side. In the present disclosure, two disposable delivery cavities 206 are arranged, the two disposable delivery cavities 206 are respectively provided with a delivery funnel. The diversion wall of the delivery funnel can be marked with a type of a corresponding washing additive, for example, "softener" is marked on a diversion wall of a delivery funnel corresponding to one of the disposable delivery cavities, while "detergent" is marked on a diversion wall of the other delivery funnel, thereby facilitating use of a user.

Preferably, a siphon cap 61 is arranged in an integrated manner at a bottom part of the delivery funnel, a siphon column 62 is arranged in an integrated manner, corresponding to the siphon cap, in the disposable delivery cavity. A diversion structure is arranged, corresponding to an outlet of the siphon column, on the lower box 20, to guide washing additive to the inside of a washing machine.

In the above solution, refer to FIG. 22, the bottom part of the delivery funnel 6 is provided with the siphon cap 61 in an integrated manner, and the siphon column 62 is arranged in an integrated manner, corresponding to the siphon cap 61, in a disposable delivery cavity 206. Such a structural setting is beneficial for cleaning the disposable delivery cavity. The structure is more reasonable. During cleaning, cleaning can be performed after a delivery funnel is detached.

Preferably, the upper box 10 of the distribution box is further provided with a washing powder delivery cavity, and the washing powder delivery cavity is used for disposable delivery of washing powder and single washing. The washing powder delivery cavity is internally provided with a diversion plate which extends in an inclined manner from a side wall on one side to a side wall of an opposite side, a washing powder outlet which is communicated to a lower box 20 is arranged, corresponding to a tail end of the diversion plate, on a bottom wall of the washing powder delivery cavity, and the lower box 20 is provided with a diversion structure to guide and mix inflowing water of washing powder to the inside of a washing machine.

In the present disclosure, the installation cavity 202 is arranged on the distribution box, the washing additive box 1 can be quickly installed and detached, and the structures of the two are in match with each other, such that the installation and detaching processes of the washing additive box 1 are convenient and simple.

Embodiment 9

The present embodiment provides a washing machine, and the washing machine is provided with the automatic delivery system for a washing machine in any or a combination of the solutions in embodiment 1 to embodiment 8.

In a clothes washing process of the washing machine in the present embodiment, when detergent needs to be added, a washing machine controls the switching mechanism to communicate the washing additive box accommodating required clothes treatment additive with the negative pressure pipeline of the negative pressure extraction mechanism. A negative pressure generated when water flow flows through the outlet of the Venturi tube extracts one or more corresponding clothes treatment additives to the main water inlet pipeline, and the clothes treatment additive enters into the water outlet of the water box through one or more outlets of the main water inlet pipeline.

Further, for the washing machine provided with a washing powder delivery box, when detergent needs to be added, a washing machine controls the switching mechanism to communicate the washing additive box accommodating required clothes treatment additive with the negative pressure pipeline in a negative pressure extraction mechanism, a negative pressure generated when water flow flows through the outlet of the Venturi tube extracts one or more corresponding clothes treatment additives to the main water inlet pipeline, and the clothes treatment additive enters into the water outlet of the water box through one or more outlets of the main water inlet pipeline. Meanwhile, water in the main water inlet pipeline simultaneously enters into the washing powder delivery box, to dissolve washing powder in the washing powder delivery box, enters into the water outlet of the water box 1001 via the outlet of the washing powder delivery box and is discharged into the washing barrel.

Further, for a washing machine provided with a disposable delivery box, a user installs different washing additive boxes 1 in the installation cavity of the distribution box 1002 of the washing machine, the liquid outlet of the washing additive box 1 is open, and is communicated with each inlet of the switching mechanism 1003. According to selection of the user, a washing machine controls the control valve at the inlet of the switching mechanism 1003 to open or close, so as to communicate one or more required washing additive boxes 1, and an outlet is communicated with the negative pressure pipeline of the negative pressure extraction mechanism. In a process in which water enters to the main water inlet pipeline of the washing machine, the negative pressure extraction mechanism extracts detergents in one or more washing additive boxes 1 to the main water inlet pipeline, and is washed to the washing barrel of the washing machine via the water outlet 1004 of the water box 1001 along with water flow. Meanwhile, water in the main water inlet pipeline simultaneously enters into the disposable delivery box to dilute detergent in the disposable delivery cavity. And diluted detergent enters into the water outlet 1004 of the water box 1001 via the outlet of the siphon structure under the effect of siphon and is discharged into a washing barrel.

Still further, when detergent needs to be added, a washing machine controls the switching mechanism to communicate the washing additive box accommodating required clothes treatment additive with a negative pressure pipeline of the negative pressure extraction mechanism, a negative pressure generated when water flow flows through an outlet of the Venturi tube extracts one or more corresponding clothes treatment additives to the main water inlet pipeline, and the clothes treatment additive enters into the water outlet of the water box through one or more outlets of the main water inlet pipeline. Meanwhile, water in the main water inlet pipeline simultaneously enters into one or more disposable delivery boxes, to dilute detergent in the disposable delivery cavity, and diluted detergent enters into the water outlet of the water box via an outlet of a siphon structure under the effect of siphon and is discharged into the washing barrel; meanwhile, water in the main water inlet pipeline simultaneously enters into a washing powder delivery box to dissolve washing powder in the washing powder delivery box, enters into the water outlet of the water box from an outlet of the washing powder delivery box and is discharged into the washing barrel.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. An automatic delivery system for a washing machine, comprising:

a water box provided with a water outlet configured to be communicated with a washing barrel of a washing machine;

a main water inlet pipeline;

a detergent delivery pipeline;

a distribution box arranged inside the water box, the distribution box being internally provided with at least one installation cavity for accommodating a washing additive box;

the washing additive box being installed in the installation cavity; wherein the washing additive box being a closed box body with a cavity for accommodating washing additive, and being provided with an unidirectional ventilation structure and a liquid outlet, the liquid outlet being open when the washing additive box is communicated with the detergent delivery pipeline, and the liquid outlet being closed when the washing additive box is disconnected with the detergent delivery pipeline; and a negative pressure extraction mechanism, including a Venturi tube arranged in the main water inlet pipeline, the washing additive being drawn out of the washing additive box and delivered into the washing barrel by a negative pressure generated by water flow through an outlet of the Venturi tube, wherein, the washing additive box is provided with a liquid outlet device, the liquid outlet device includes an on-off valve arranged on the liquid outlet of the washing additive box and a suction device arranged in the washing additive box, wherein the suction device is a hollow tubular structure, a flow channel is formed inside the suction device, one end of the flow channel faces a bottom wall of the washing additive box, and another end of the flow channel is connected with the inlet of the on-off valve.

2. The automatic delivery system for the washing machine according to claim 1, wherein the distribution box is provided with a first installation part having at least one installation cavity and a second installation part for enabling a washing powder delivery box to be arranged therein, the washing additive box is installed in the first installation part;

the washing powder delivery box is provided with a washing powder delivery cavity, and the washing powder delivery cavity is respectively communicated with an outlet of the main water inlet pipeline and a water outlet of the water box to pour washing powder into the washing barrel.

3. The automatic delivery system for the washing machine according to claim 1, wherein the distribution box is provided with a first installation part having at least one installation cavity and a second installation part for enabling a disposable delivery box to be arranged therein, the washing additive box is installed in the first installation part, the disposable delivery box is provided with a disposable delivery cavity, the disposable delivery cavity is internally provided with a siphon structure, the disposable delivery cavity is communicated with an outlet of the main water inlet pipeline located at an upstream of the disposable delivery cavity, and an outlet of the siphon structure is communicated with a water outlet of the water box.

4. The automatic delivery system for the washing machine according to claim 1, wherein the distribution box is provided with a first installation part having at least one installation cavity, a second installation part for enabling a disposable delivery box to be arranged therein and a third installation part for enabling a washing powder delivery box to be arranged therein, and the washing additive box is installed in the first installation part, the disposable delivery box is provided with a disposable delivery cavity having a siphon structure internally; the disposable delivery cavity is communicated with an outlet of the main water inlet pipeline located upstream of the disposable delivery cavity, and an outlet of the siphon structure is communicated with a water outlet of the water box; and the washing powder delivery box is provided with a washing powder delivery cavity, the washing powder delivery cavity is respectively communicated with an outlet of the main water inlet pipeline and a water outlet of the water box to pour washing powder into the washing barrel.

5. The automatic delivery system for the washing machine according to claim 1, comprising a switching mechanism, wherein at least two washing additive boxes are arranged, the switching mechanism is provided with inlets corresponding to the number of washing additive boxes and at least one outlet, each inlet of the switching mechanism is correspondingly communicated with one washing additive box, and at least one outlet is communicated with the negative pressure extraction mechanism.

6. The automatic delivery system for the washing machine according to claim 1, wherein an air pressure difference between an inner and an outer of the washing additive box makes the unidirectional ventilation structure be open for unidirectional air permeability, or makes the unidirectional ventilation structure be closed to seal the washing additive box.

7. The automatic delivery system for the washing machine according to claim 1, wherein the washing additive box is provided with a liquid inlet, a liquid inlet cover is arranged at the liquid inlet in a detachable and sealed manner, and the unidirectional ventilation structure is arranged on the liquid inlet cover in a sealed manner.

8. The automatic delivery system for the washing machine according to claim 1, wherein the on-off valve comprises a drainage channel and a piston and a reset spring arranged in the drainage channel, and the piston blocks the drainage channel under the effect of the reset spring.

9. The automatic delivery system for the washing machine according to claim 1, wherein the installation cavity is provided with a limit structure, the limit structure comprises an elastic piece arranged at one side of the installation cavity, and the elastic piece is configured to be arranged between the washing additive box and a side wall of the installation cavity in an elastically deformed manner when the washing additive box is placed in the installation cavity.

10. The automatic delivery system for the washing machine according to claim 9, wherein multiple washing additive boxes are arranged in the installation cavity in a parallel manner, the limit structure further comprises at least one separating rib arranged at a bottom wall of the installation cavity for separating one washing additive box from each other.

11. The automatic delivery system for the washing machine according to claim 2, wherein the installation cavity and the washing powder delivery box are set to be adjacent to each other in a parallel manner, the washing powder delivery cavity is internally provided with a diversion plate, the diversion plate extends from one side wall of the washing powder delivery cavity to an opposite side wall in an inclined manner, a bottom wall of the washing powder delivery cavity is provided with a washing powder outlet, and the washing powder outlet is communicated with the water outlet of the water box.

12. The automatic delivery system for the washing machine according to claim 3, wherein the installation cavity and multiple disposable delivery boxes are adjacent to each other in a parallel manner, an open end of the disposable delivery cavity is provided with a delivery funnel, and an outlet of the delivery funnel is relative to an opening of the disposable delivery cavity.

13. The automatic delivery system for the washing machine according to claim 1, wherein the distribution box comprises an upper box and a lower box, the upper box and the lower box are detachable or integrated, the lower box is provided with a diversion structure communicated to the water outlet of the water box, the installation cavity, the disposable delivery box and the washing powder delivery box are arranged in the upper box, a bottom wall of the installation cavity is formed with a through hole communicated with the lower box, an outlet of the siphon structure is communicated with the lower box, and the outlet of the washing powder delivery box is communicated with the lower box.

14. A washing machine provided with the automatic delivery system according to claim 1.

15. The automatic delivery system for the washing machine according to claim 6 wherein the unidirectional ventilation structure comprises a ventilation element and a switching element, the ventilation element is provided with a venting hole, the switching element comprises a switching part, and an air pressure difference between the inner and the outer of the washing additive box makes the switching part be open or closed to make the venting hole ventilate unidirectionally or be closed.

16. The automatic delivery system for the washing machine according to claim 1 wherein a diversion channel with a cambered shape is formed between an inlet and an outlet in the flow channel, and a diversion point of the flow channel corresponding to the inlet of an on-off valve is an arc surface extended outwardly.

17. The automatic delivery system for the washing machine according to claim 10 wherein the separating rib and the elastic piece are set in a homonymous manner, the separating rib limits movement of the washing additive box in a first direction, and the elastic piece limits movement of the washing additive box in a second direction vertical to the first direction.

18. The automatic delivery system for the washing machine according to claim 12 wherein a bottom part of the delivery funnel is provided with a siphon cap in an integrated manner, a siphon column is integrally disposed at a position corresponding to the siphon cap in the disposable delivery cavity, and an outlet of the siphon column is communicated with a water outlet of the water box.

* * * * *